US010364115B2

(12) United States Patent
Oda et al.

(10) Patent No.: US 10,364,115 B2
(45) Date of Patent: Jul. 30, 2019

(54) SHEET STICKING APPARATUS AND STICKING METHOD

(71) Applicant: LINTEC Corporation, Tokyo (JP)

(72) Inventors: Shuji Oda, Tokyo (JP); Akira Dangami, Tokyo (JP)

(73) Assignee: LINTEC CORPORATION, Tokyo (JP)

( * ) Notice: Subject to any disclaimer, the term of this patent is extended or adjusted under 35 U.S.C. 154(b) by 343 days.

(21) Appl. No.: 15/369,374

(22) Filed: Dec. 5, 2016

(65) Prior Publication Data

US 2017/0247215 A1 Aug. 31, 2017

(30) Foreign Application Priority Data

Feb. 29, 2016 (JP) ..... 2016-037709

(51) Int. Cl.

| | |
|---|---|
| ***B65H 20/02*** | (2006.01) |
| ***B65H 37/04*** | (2006.01) |
| ***B65H 45/16*** | (2006.01) |
| ***B65H 45/12*** | (2006.01) |

(52) U.S. Cl.

CPC ..... *B65H 20/02* (2013.01); *B65H 37/04* (2013.01); *B65H 45/12* (2013.01); *B65H 45/16* (2013.01); *B65H 2301/44335* (2013.01); *B65H 2301/5161* (2013.01); *B65H 2404/5391* (2013.01); *B65H 2404/64* (2013.01); *B65H 2404/693* (2013.01); *B65H 2701/186* (2013.01); *B65H 2701/194* (2013.01)

(58) Field of Classification Search

CPC ..... B65H 20/02; B65H 2301/44335; B65H 2301/5161; B65H 2701/186; B65H 2701/194

USPC ..... 493/379; 156/249, 289, 227, 217, 247, 156/297–298, 443

See application file for complete search history.

(56) References Cited

U.S. PATENT DOCUMENTS

| | | | | |
|---|---|---|---|---|
| 6,057,019 | A * | 5/2000 | Barry | G09F 3/0289 281/2 |
| 6,378,588 | B1 * | 4/2002 | Nixon | B65C 9/08 156/217 |
| 6,511,569 | B1 * | 1/2003 | Nixon | B65C 9/08 156/227 |
| 7,762,302 | B2 * | 7/2010 | Dangami | B65C 9/1865 156/387 |

(Continued)

FOREIGN PATENT DOCUMENTS

| | | | |
|---|---|---|---|
| JP | 2006-160328 | A | 6/2006 |
| JP | 2016117521 | A * | 6/2016 |

(Continued)

*Primary Examiner* — Sameh Tawfik
*Assistant Examiner* — Valentin Neacsu
(74) *Attorney, Agent, or Firm* — Oliff PLC

(57) ABSTRACT

A sheet sticking apparatus includes a feeder configured to feed an adhesive sheet, a folding unit configured to fold the fed adhesive sheet, and an attaching unit configured to press the folded adhesive sheet onto an adherend to stick the adhesive sheet to the adherend. The adhesive sheet includes a first sheet and a second sheet having a feeding-direction leading end temporarily attached to a feeding-direction rear end of the first sheet. The folding unit includes a deflecting section configured to deflect the second sheet into a reverse V-shape.

2 Claims, 5 Drawing Sheets

(56) References Cited

U.S. PATENT DOCUMENTS

| | | | | |
|---|---|---|---|---|
| 2009/0084503 | A1* | 4/2009 | Kobayashi | B65C 9/1884<br>156/443 |
| 2009/0229735 | A1* | 9/2009 | Nonaka | H01L 21/67132<br>156/64 |
| 2010/0006232 | A1* | 1/2010 | Dangami | B65C 9/1865<br>156/387 |
| 2011/0198038 | A1* | 8/2011 | Yoshioka | H01L 21/67132<br>156/543 |
| 2013/0126100 | A1* | 5/2013 | Fujita | B65C 9/0006<br>156/719 |

FOREIGN PATENT DOCUMENTS

| | | | | | |
|---|---|---|---|---|---|
| JP | 2016117522 | A | * | 6/2016 | |
| WO | WO-2012017750 | A1 | * | 2/2012 | B65C 9/0006 |
| WO | WO-2016166927 | A1 | * | 10/2016 | B65C 9/18 |

* cited by examiner

SHEET STICKING APPARATUS AND STICKING METHOD

The entire disclosure of Japanese Patent Application No. 2016-037709 filed Feb. 29, 2016 is expressly incorporated by reference herein.

TECHNICAL FIELD

The present invention relates to a sheet sticking apparatus and a sticking method.

BACKGROUND ART

A sheet sticking apparatus configured to fold an adhesive sheet, in which a feeding-direction rear end of a first sheet is connected to a feeding-direction leading end of a second sheet, and stick the adhesive sheet to an adherend has been typically known (see, for example, Document 1: JP-A-2006-160328).

However, the typical sheet sticking apparatus of Document 1 described above has the following disadvantage. When an adhesive sheet to be stock to an adherend includes a first sheet PS1 and a second sheet PS2 having a feeding-direction leading end PS21 temporarily attached to a feeding-direction roar end PS11 of the first sheet PS1 as shown in FIG. 5A, the feeding-direction leading end PS21 of the second sheet PS2 may not be released from the feeding-direction rear end PS11 of the first sheet PS1 as shown in FIG. 5B. Accordingly, the feeding-direction leading end PS21 of the second sheet PS2 may not be stuck to the adherend.

SUMMARY OF THE INVENTION

An object of the invention is to provide a sheet sticking apparatus and a sheet sticking method capable of sticking an adhesive sheet including a first sheet and a second sheet having a feeding-direction leading end temporarily attached to a feeding-direction roar end of the first sheet to an adherend while exposing a surface of the feeding-direction leading end of the second sheet facing the first sheet.

A sheet sticking apparatus according to an aspect of the invention includes: a feeder configured to feed an adhesive sheet; a folding unit configured to fold the fed adhesive sheet; and an attaching unit configured to press the folded adhesive sheet onto an adherend to stick the adhesive sheet to the adherend, wherein the adhesive sheet includes a first sheet and a second sheet having a feeding-direction leading end temporarily attached to a feeding-direction rear end of the first sheet, and the folding unit includes a deflecting section configured to deflect the second sheet into a reverse V-shape and release the feeding-direction leading end of the second sheet from the feeding-direction rear end of the first sheet so that a surface of the feeding-direction leading end of the second sheet facing the first sheet is exposed by the deflecting section and the adhesive sheet is folded.

In the above arrangement, the deflecting section includes a drive roller driven by a drive unit and a pinch roller configured to pinch the adhesive sheet in cooperation with the drive roller, the drive roller and the pinch roller stop flow of the feeding-direction leading end of the second sheet while the feeder feeds the adhesive sheet to deflect the second sheet into the reverse V-shape, and the adhesive sheet in which the surface of the feeding-direction leading end of the second sheet facing the first sheet is exposed passes through a space between the drive roller and the pinch roller so that the adhesive sheet is folded.

A sheet sticking method according to an another aspect of the invention includes: feeding an adhesive sheet, the adhesive sheet including a first sheet and a second sheet having a feeding-direction leading end temporarily attached to a feeding-direction rear end of the first sheet; folding the fed adhesive sheet, the folding comprising deflecting in which the second sheet is deflected into a reverse V-shape and the feeding-direction leading and of the second sheet is released from the feeding-direction rear end of the first sheet and a surface of the feeding-direction leading end of the second sheet facing the first sheet is exposed before the folding of the fed adhesive sheet; and pressing the folded adhesive sheet onto an adherend to stick the adhesive sheet to the adherend.

According to the above aspects of the invention, when the adhesive sheet to be stuck to the adherend includes the first sheet and the second sheet having the feeding-direction leading end temporarily attached to the feeding-direction rear end of the first sheet, since the second sheet is deflected into a substantially reverse V-shape, the feeding-direction leading and of the second sheet is deformed to be raised up from the feeding-direction rear end of the first sheet. Accordingly, the feeding-direction leading end of the second sheet can be released from the feeding-direction rear end of the first sheet, and the adhesive sheet can be stuck to the adherend while the surface of the feeding-direction leading end of the second sheet facing the first sheet is exposed.

When the deflecting section includes the drive roller and the pinch roller, it is possible to release the feeding-direction leading end of the second sheet from the first sheet with a simple structure and fold the adhesive sheet in which the surface of the feeding-direction leading end of the second sheet facing the first sheet is exposed.

BRIEF DESCRIPTION OF DRAWING(S)

DESCRIPTION OF EMBODIMENT(S)

An exemplary embodiment of the invention will be described below with reference to the attached drawings.

According to this exemplary embodiment, an X axis, a Y axis, and a Z axis are orthogonal to one another. The X axis and the Y axis are defined within a predetermined plane, and the Z axis is orthogonal to the predetermined plane. According to this exemplary embodiment, a reference state is defined as viewed from a near side in a direction in parallel with the Y-axis in FIG. 1. A direction of "upper" means a direction indicated by an arrow of the Z-axis and a direction of "lower" means a direction opposite thereto. A direction of "left" means a direction indicated by an arrow of the X-axis and a direction of "right" means a direction opposite thereto. A direction of "front" is defined as viewed from the near side in the direction in parallel with the Y-axis in FIG. 1 and a direction of "back" means a direction opposite thereto.

Figure 1:
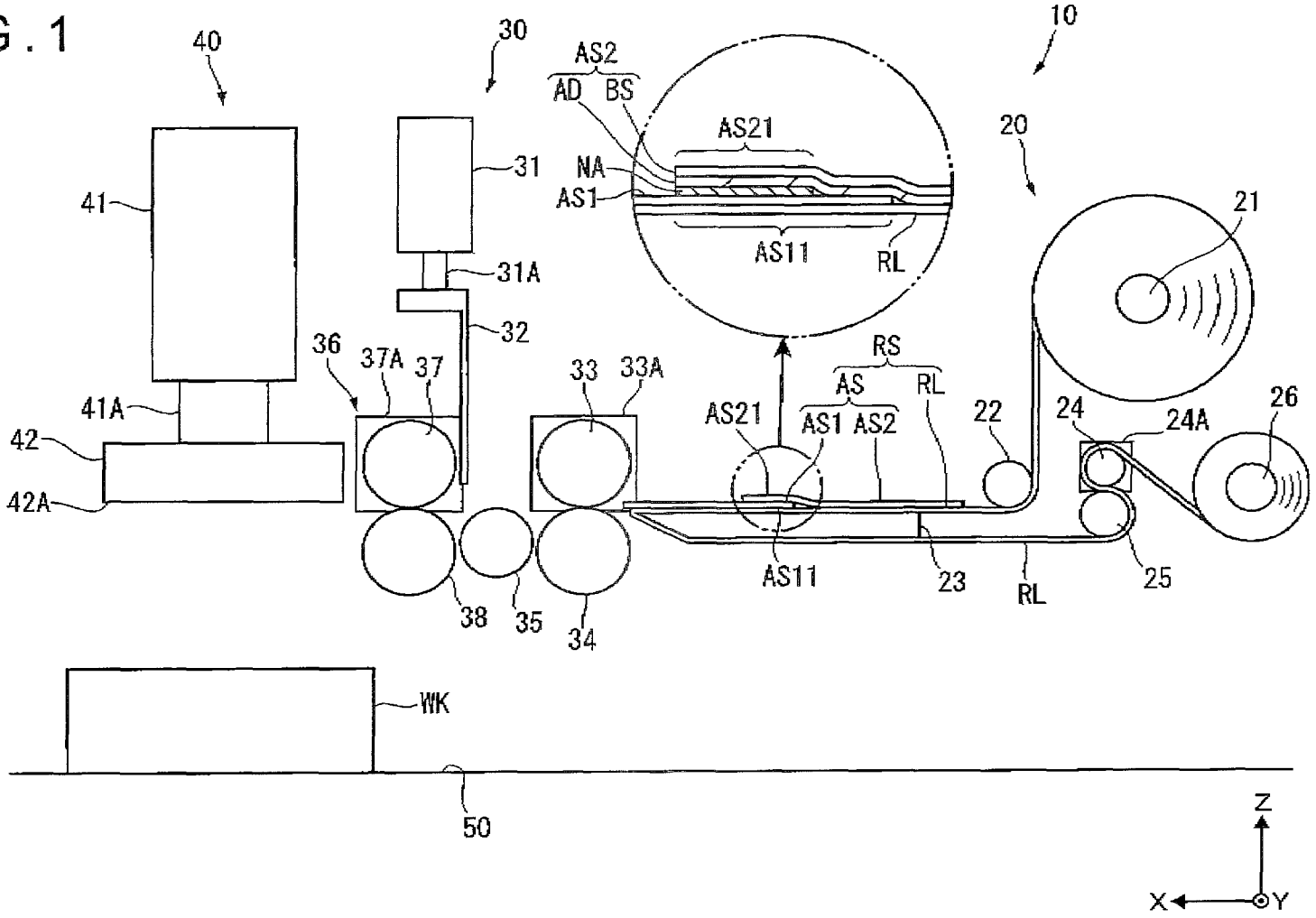
FIG. 1 is a side view of a sheet sticking apparatus according to an exemplary embodiment of the invention.

As shown in FIG. 1, a sheet sticking apparatus 10 includes a feeder 20 configured to feed an adhesive sheet AS, a folding unit 30 configured to fold the fed adhesive sheet AS and an attaching unit 40 configured to press the folded adhesive sheet AS onto an adherend WK so that the folded adhesive sheet AS is stuck to the adherend WK. The sheet sticking apparatus 10 is disposed above a transport unit 50 (e.g., a conveyor and a robot) configured to transport the adherend WK. The adhesive sheet AS includes a first sheet AS1 and a second sheet AS2 having an outer profile larger than that of the first sheet AS1. The first sheet AS1 has a feeding-direction rear end AS11 provided with a non-adhesion layer NA such as a silicone resin layer and a fluorine resin layer. The second sheet AS2 has a base material BS and an adhesive layer AD formed on one of surfaces of the base material BS. A feeding-direction leading end AS21 of the second sheet AS2 is temporarily attached to a feeding-direction rear end AS11 of the first sheet AS1.

The feeder 20 includes a support roller 21 configured to support a material sheet RS obtained by temporarily attaching the adhesive sheet AS to one of surfaces of a belt-shaped releasable sheet RL, a guide roller 22 configured to guide the material sheet RS, a releasing plate 23 (releasing unit) configured to release the adhesive sheet AS from the releasable sheet RL, a drive roller 24 driven by a rotary motor 24A (drive unit), a pinch roller 25 configured to pinch the releasable sheet RL in cooperation with the drive roller 24, and a collecting roller 26 configured to collect the releasable sheet RL.

The folding unit 30 includes a linear movement motor 31 (drive unit), a guide member 32 supported by an output shaft 31A of the linear movement motor 31, a drive roller 33 driven by a rotary motor 33A (drive unit), a pinch roller 34 configured to pinch the adhesive sheet AS in cooperation with the drive roller 33, two guide rollers 35 (guiding unit) arranged in parallel to each other at an interval larger than a width of the first sheet AS1 in the front-back direction and configured to guide the second sheet AS2, and a deflecting section 36 configured to deflect the second sheet AS2 into a substantially reverse V-shape and release the leading end AS21 of the second sheet AS2 from the rear end AS11 of the first sheet AS1. In the deflecting section 36, the surface of the leading end AS21 of the second sheet AS2 facing the first sheet AS1 is exposed and the adhesive sheet AS is folded.

The deflecting section 36 includes a drive roller 37 driven by a rotary motor 37A (drive unit) and a pinch roller 38 configured to pinch the adhesive sheet AS in cooperation with the drive roller 37. While the feeder 20 feeds the adhesive sheet AS, the drive roller 37 and the pinch roller 38 function to stop the flow of the leading end AS21 of the second sheet AS2 so that the second sheet AS2 is deflected into the substantially reverse V-shape and the adhesive sheet AS in which the adhesive layer AD at the leading end AS21 of the second sheet AS2 is exposed passes through a space between the drive roller 37 and the pinch roller 38, thereby folding the adhesive sheet AS.

The attaching unit 40 includes a linear movement motor 41 (drive unit) and a holder 42 supported by an output shaft 41A of the linear movement motor 41 and made of a deformable member such as rubber, resin and sponge. The holder 42 has a holding surface 42A capable of sucking and holding the adhesive sheet AS by a decompression unit (not illustrated) such as a decompression pump and a vacuum ejector.

A process of sticking the adhesive sheet AS to the adherend WK by the sheet sticking apparatus 10 described above will be described below.

Firstly, an operator sets the material sheet RS as shown in FIG. 1 to the sheet sticking apparatus 10 with each component being disposed at an initial position as shown by solid lines in FIG. 1. Thereafter, the operator inputs a signal for starting an automatic operation of the sheet sticking apparatus 10 using an input unit such as a control panel, a personal computer, or the like (not illustrated). Subsequently, the feeder 20 drives the rotary motor 24A to feed the adhesive sheet AS. When a not-illustrated detector such as an optical sensor and an imaging unit detects that the leading adhesive sheet AS located on the releasing plate 23 has reached a predetermined position, the feeder 20 stops the driving of the rotary motor 24A, and the sheet sticking apparatus 10 is brought into a stand-by state.

Figure 2A:
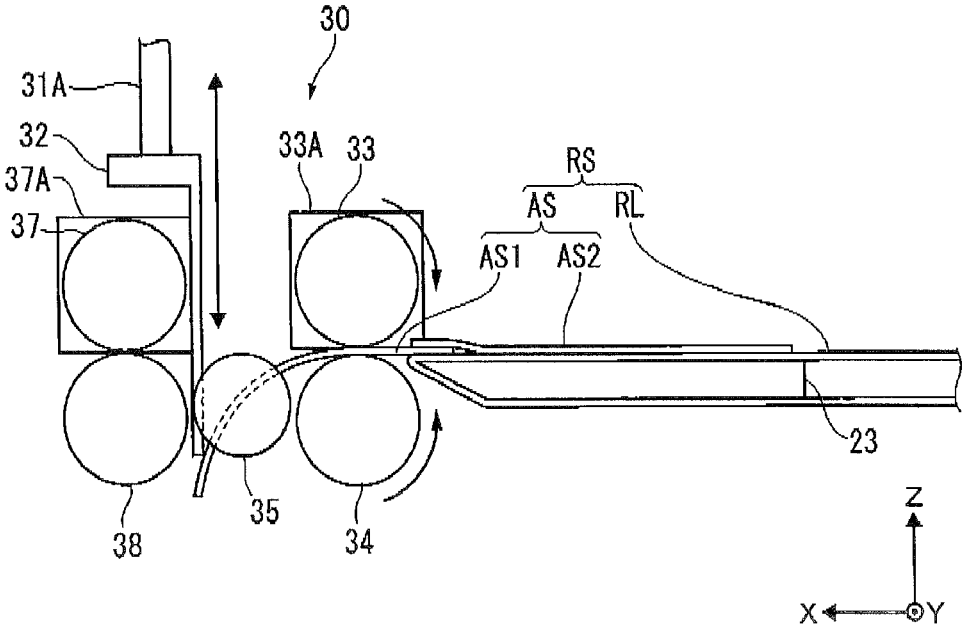
FIG. 2A is a partial side view of the sheet sticking apparatus.
Figure 2B:
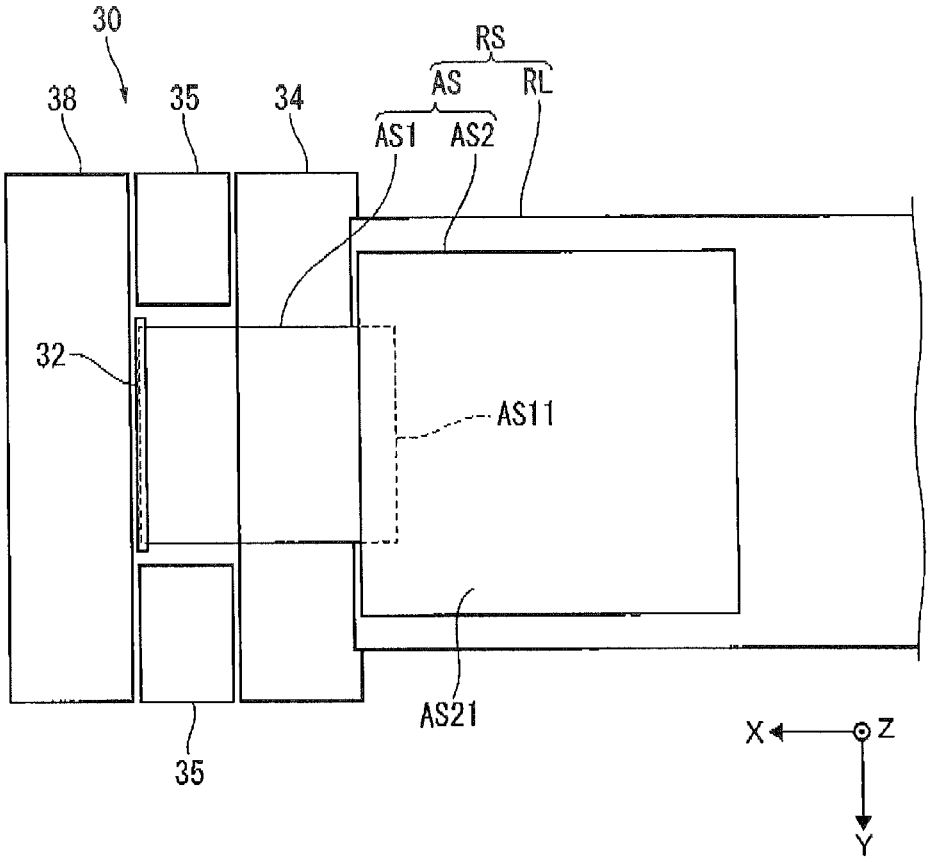
FIG. 2B is a top view of FIG. 2A.

Thereafter, the transport unit 50 drives the conveyor or the like, and as shown in FIG. 1, the adherend WK is stopped at a predetermined position below the holder 42. Next, the feeder 20 drives the rotary motor 24A to feed the adhesive sheet AS, and the folding unit 30 drives the rotary motor 33A to pinch the first sheet AS1 released from the releasable sheet RL between the drive roller 33 and the pinch roller 34 and feed the first sheet AS1 to the let. Then, the folding unit 30 drives the linear movement motor 31, and as shown in FIGS. 2A and 2B, after the guide member 32 guides the first sheet AS1 to a position below the pinch roller 38, the guide member 32 is maimed to the initial position. Subsequently, the folding unit 30 drives the rotary motor 37A to rotate the drive roller 37.

Figure 3A:
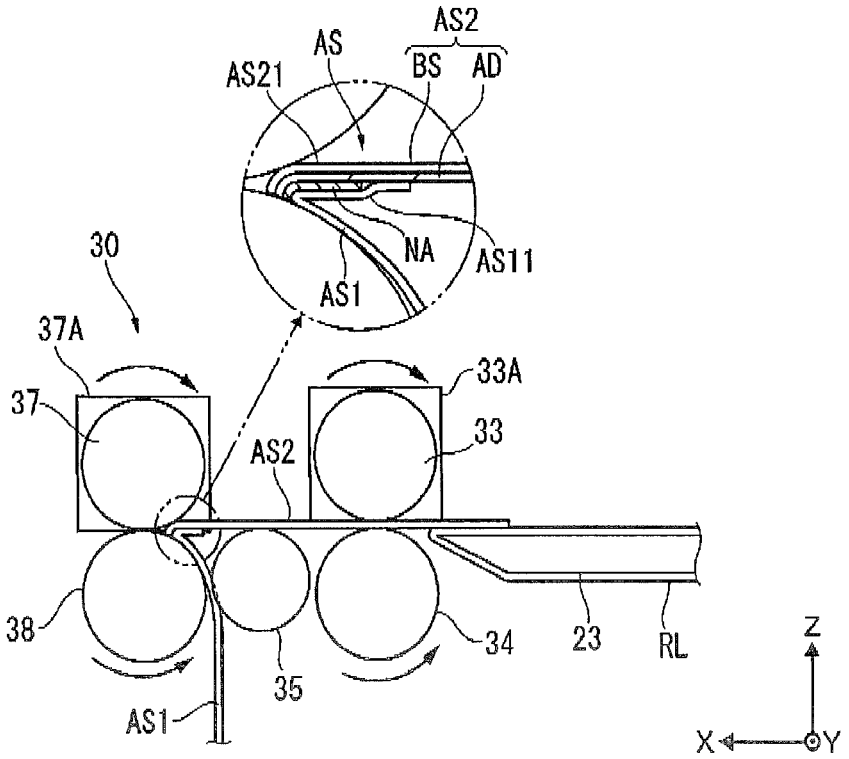
FIG. 3A illustrates an operation of the sheet sticking apparatus.
Figure 3B:
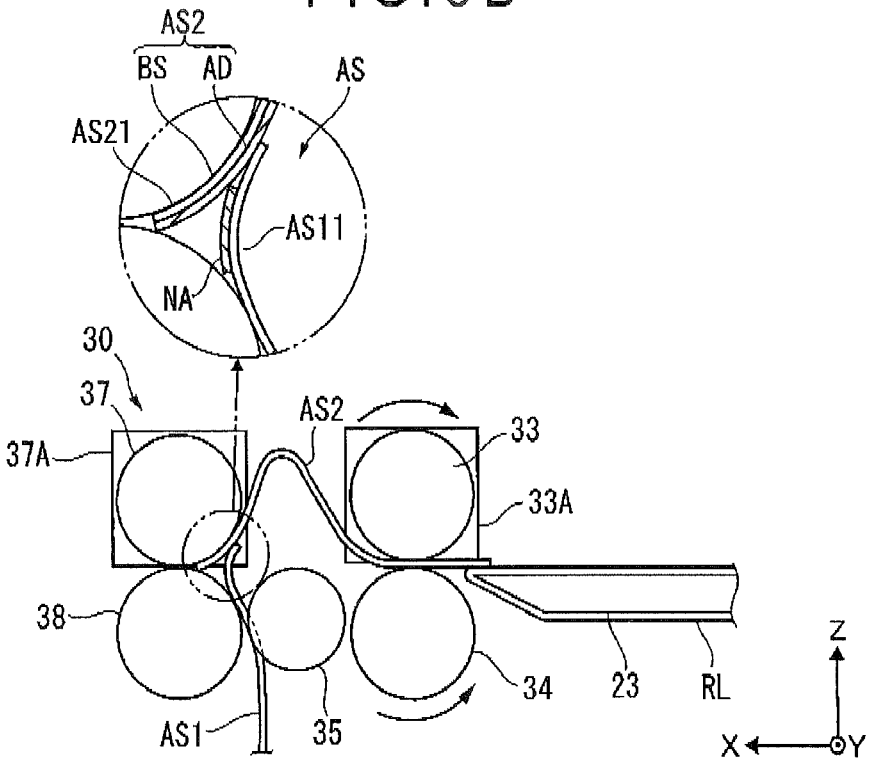
FIG. 3B illustrates an operation of the sheet sticking apparatus.

Thereafter, when the adhesive sheet AS is fed to the left, as shown in FIG. 3A, the adhesive sheet AS is fed while the first sheet AS1 is folded back by the pinch roller 38. When the leading end AS21 of the second sheet AS2 reaches the drive roller 37 and the pinch roller 38, the folding unit 30 stops the driving of the rotary motor 37A so as to stop the flow of the leading end AS21 of the second sheet AS2. Subsequently, the second sheet AS2 gets a push from the drive roller 33, and is deformed into the substantially reverse V-shape as shown in FIG. 3B. Subsequently, the leading end AS21 of the second sheet AS2 is raised up and a clearance between the leading end AS21 and the pinch roller 38 is increased to generate an escape space for the folded portion of the rear end AS11 of the first sheet AS1, so that the leading end AS21 is released from the rear end AS11 of the first sheet AS1 and the adhesive layer AD at the leading end AS21 of the second sheet AS2 is exposed.

Figure 4:
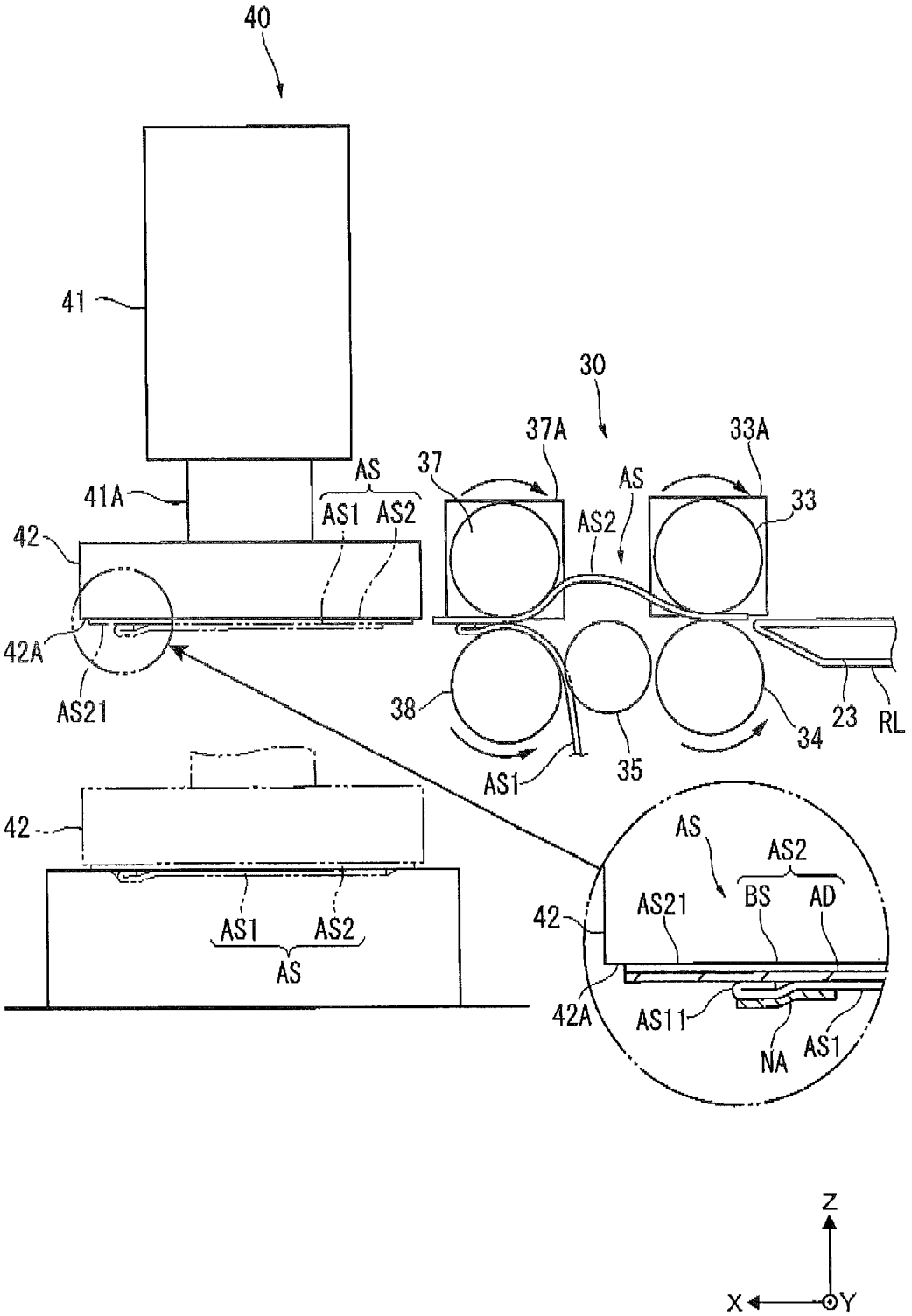
FIG. 4 illustrates an operation of the sheet sticking apparatus.
Figure 5A:
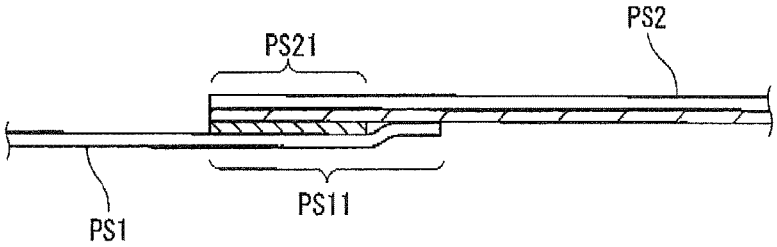
FIG.5A RELATED ART
FIG. 5A illustrates an example of a defect in a typical sheet sticking apparatus.
Figure 5B:
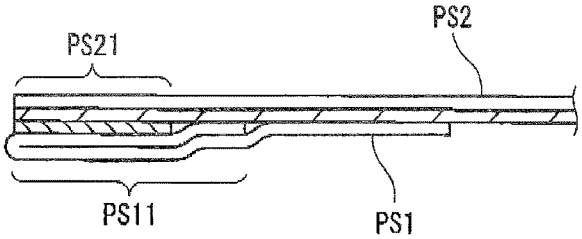
FIG.5B RELATED ART
FIG. 5B illustrates an example of a defect in a typical shoot sticking apparatus.

Next, when the top of the second sheet AS2 deformed into the substantially reverse V-shape is detected by a not-illustrated detector such as an imaging unit (e.g., a camera) and an optical sensor, the folding unit 30 drives the rotary motor 37A so that the adhesive sheet AS is fed to the left at a speed faster than a speed for feeding the adhesive sheet AS using the drive roller 33 while the adhesive sheet AS is folded by the drive roller 37 and the pinch roller 38, as shown in FIG. 4. Subsequently, the adhesive sheet AS is fed to a position below the holding surface 42A. The attaching unit 40 drives the not-illustrated decompression unit so that the adhesive sheet AS is held on the holding surface 42A as shown by chain double-dashed lines in FIG. 4, and then the folding unit 30 stops the driving of the rotary motors 33A and 37A. The attaching unit 40 drives the linear movement motor 41 so that the holder 42 is moved down toward the adherend WK and the adhesive sheet AS is pressed against and stuck to the adherend WK as shown by the chain double-dashed lines in FIG. 4.

After stopping the driving of the not-illustrated decompression unit, the attaching unit 40 drives the linear movement motor 41 so as to return the holder 42 to the initial position. Thereafter, the transport unit 50 drives the conveyor or the like so that the adherend WK to which the adhesive sheet AS is stuck is transported to the next process. Subsequently, the operation similar to the above is repeated.

According to the above exemplary embodiment, even when the adhesive sheet AS to be stuck to the adherend WK includes the first sheet AS1 and the second sheet AS2 having the feeding-direction leading end AS21 temporarily attached to the feeding-direction rear end AS11 of the first sheet AS1, since the second sheet AS2 is deflected into the substantially reverse V-shape, the feeding-direction leading end AS21 of the second sheet AS2 is deformed to be raised up from the feeding-direction rear end AS11 of the first sheet AS1, and subsequently the feeding-direction leading end AS21 of the second sheet AS2 is released from the feeding-direction rear end AS11 of the first sheet AS1, so that the surface of the feeding-direction leading end AS21 of the second sheet AS2 facing the first sheet AS1 is exposed and the adhesive sheet AS is stuck to the adherend WK.

Although the best arrangement and method for implementing the Invention has been disclosed above, the invention is not limited thereto. In other words, while the invention has been described with reference to the specific embodiments and the drawings thereof various modifications may be made on shapes, materials, quantities and other specific configurations to the disclosed exemplary embodiments by those of ordinary skill in the art without departing from the spirit and scope of the invention. The description limiting the shapes and the materials disclosed above is intended to be illustrative for easier understanding and not to limit the invention, hence the invention includes the description using a name of component without a part of or all of the limitation on the shape and the material etc.

For instance, the feeder 20 may release the adhesive sheet AS from the material sheet and feed the released adhesive sheet AS.

The releasing unit may be a round bar, a roller, or the like.

The folding unit 30 may blow a gas to the first sheet AS1 so as to guide the first sheet AS1 to a position below the pinch roller 38. When the first sheet AS1 is heavy enough to hang downwardly toward the pinch roller 38, the linear movement motor 31 and the guide member 32 are not necessary, the drive roller 33 and the pinch roller 34 may not be provided, and a guide roller may be used instead of the drive roller 33.

The deflecting section may include an auxiliary deflecting section configured to blow a gas to the second sheet AS2, push up the leading end AS21 using a plate or a bar, or suck a gas to draw up the leading end AS21 in order to assist the second sheet AS2 to be deformed into the substantially reverse V-shape. Alternatively, the deflecting section may be configured to deform the second sheet AS2 into a reverse V-shape by feeding the adhesive sheet AS at a speed slower than the speed for feeding the adhesive sheet AS using the drive roller 33 instead of stopping the flow of the feeding-direction leading end AS21 of the second sheet AS2.

The guiding unit may be a plate or a bar, or the guiding unit may be omitted. Air or a bar may be used to guide the second sheet AS2 instead of using the guide rollers 35.

At least a portion, which is brought into contact with the adhesive layer AD of the adhesive sheet AS, of at least one of the pinch roller 34, the guide roller 35 and the pinch roller 38 may be made of a material used for the non-adhesion layer such as silicone resin and fluorine resin. Alternatively, at least one of the pinch roller 34, the guide roller 35 and the pinch roller 38 may be entirely made of a material used for the non-adhesion layer.

The attaching unit 40 may blow air from the holding surface 42A to press the adhesive sheet AS onto the adherend WK so that the adhesive sheet AS is stuck to the adherend WK.

The holder 42 may hold the adhesive sheet AS using a chuck unit such as a mechanical chuck and a chuck cylinder, a mechanism using Coulomb's force, adhesive, pressure-sensitive adhesive, magnetic force or Bernoulli adsorption, and a drive unit.

The adhesive sheet AS may be configured so that, when being folded, the first sheet AS1 goes beyond the profile of the second sheet AS2, the non-adhesion layer NA is not provided, and the first sheet AS1 and the second sheet AS2 are temporarily attached to each other only through the non-adhesion layer NA. Alternatively, one of the adhesive sheets may be folded three or more times so that an area at the feeding-direction leading end of the adhesive sheet is defined as the first sheet and an area at the feeding-direction rear end of the adhesive sheet is defined as the second sheet. In this case, a surface of the second sheet, which is opposed to the first sheet, is provided with the adhesive layer AD.

The adhesive sheet AS and the adherend WK are not particularly limited in terms of material, type, shape and the like. For instance, each of the adhesive sheet AS, the first sheet AS1 and the second sheet AS2 may be in the shape of a circle, ellipse, polygon such as a triangle and quadrangle, or other shapes. The adhesive sheet AS may be a pressure-sensitive adhesive sheet, a heat-sensitive adhesive sheet or the like. When the adhesive sheet AS having the heat-sensitive adhesiveness is used, the adhesive sheet AS may be stuck to an adherend in an appropriate manner, for example, by providing a heating unit configured to heat the adhesive sheet AS such as a coil heater and heat pipe. For instance, the adherend WK may be a member or article in any form such as food, resin container, semiconductor wafer (e.g., silicon semiconductor wafer and a compound semiconductor wafer), circuit board, information recording media (e.g., an optical disc), glass plate, steel plate, pottery, wooden plate and resin plate. It should be noted that the adhesive sheet AS may be named after a function or an intended use thereof. For instance, the adhesive sheet AS may be provided in the form of a sheet, film, tape or the like in a predetermined shape (e.g., an information recording label, a decoration label, a protection sheet, a dicing tape, a die-attach film, die-bonding tape, and a resin sheet for forming a recording layer) attachable to the adherend WK described above.

The invention is by no means limited to the above units and processes as long as the above operations, functions or processes of the units and processes are achievable, still less to the above merely exemplary arrangements and processes described in the exemplary embodiment. For instance, the feeder is by no means limited as long as the feeder can feed the adhesive sheet and falls within a relevant technical scope in view of common techniques at the time of the filing of this application (description of the other units and processes are omitted).

The driving unit in the above exemplary embodiment may be provided by: motorized equipment such as a rotary motor, linear movement motor, linear motor, single-spindle robot and multi-joint robot; an actuator such as an air cylinder, hydraulic cylinder, rodless cylinder and rotary cylinder, and a direct or indirect combination thereof (some of the driving units overlap with the exemplified driving units in the exemplary embodiment).

What is claimed is:

1. A sheet sticking apparatus comprising:

a feeder configured to feed an adhesive sheet;

a folding unit configured to fold the fed adhesive sheet; and an attaching unit configured to press the folded adhesive sheet onto an adherend to stick the adhesive sheet to the adherend, wherein:

the adhesive sheet includes (i) a first sheet and (ii) a second sheet having a feeding-direction leading end temporarily attached to a feeding-direction rear end of the first sheet, and the folding unit includes a deflecting section configured to deflect the second sheet into a reverse V-shape and release the feeding-direction leading end of the second sheet from the feeding-direction rear end of the first sheet wherein a surface of the feeding-direction leading end of the second sheet facing the first sheet is exposed by the deflecting section and the adhesive sheet is folded.

2. The sheet sticking apparatus according to claim 1, wherein:

the deflecting section includes (i) a drive roller driven by a drive unit and (ii) a pinch roller to pinch configured to pinch the adhesive sheet in cooperation with the drive roller, the drive roller and the pinch roller stop flow of the feeding-direction leading end of the second sheet while the feeder feeds the adhesive sheet to deflect the second sheet into the reverse V-shape, and the adhesive sheet, in which the surface of the feeding-direction leading end of the second sheet facing the first sheet is exposed, passes through a space between the drive roller and the pinch roller so that the adhesive sheet is folded.

* * * * *